US011964212B2

(12) United States Patent
Yang et al.

(10) Patent No.: US 11,964,212 B2
(45) Date of Patent: Apr. 23, 2024

(54) GAME BOARD DEVICE

(71) Applicant: PIXART IMAGING INC., Hsin-Chu (TW)

(72) Inventors: Chung-Ting Yang, Hsin-Chu (TW); Yen-Min Chang, Hsin-Chu (TW); Yen-Chang Wang, Hsin-Chu (TW)

(73) Assignee: PIXART IMAGING INC., Hsin-Chu (TW)

( * ) Notice: Subject to any disclaimer, the term of this patent is extended or adjusted under 35 U.S.C. 154(b) by 0 days.

(21) Appl. No.: 17/563,289

(22) Filed: Dec. 28, 2021

(65) Prior Publication Data

US 2023/0201706 A1 Jun. 29, 2023

(51) Int. Cl.

| | |
|---|---|
| ***A63F 3/02*** | (2006.01) |
| ***A63F 3/00*** | (2006.01) |
| ***A63F 9/24*** | (2006.01) |

(52) U.S. Cl.

CPC ..... *A63F 3/02* (2013.01); *A63F 3/00643* (2013.01); *A63F 2003/00646* (2013.01); *A63F 2003/00662* (2013.01); *A63F 2009/2419* (2013.01)

(58) Field of Classification Search

CPC ..... A63F 3/02; A63F 3/00643; A63F 2003/00646; A63F 2003/00662; A63F 2009/2419

See application file for complete search history.

(56) References Cited

U.S. PATENT DOCUMENTS

| | | | | |
|---|---|---|---|---|
| 4,372,558 | A * | 2/1983 | Shimamoto | A63F 13/12 463/31 |
| 5,129,654 | A * | 7/1992 | Bogner | A63F 3/00643 434/128 |
| 9,747,749 | B1 * | 8/2017 | Wisler | G07F 17/3248 |
| 2008/0058045 | A1 * | 3/2008 | Cortenraad | A63F 3/00643 463/9 |

(Continued)

OTHER PUBLICATIONS

Xiangqi, Nov. 25, 2021, wikipedia.org, printed on Jan. 11, 2023, available <<https://en.wikipedia.org/w/index.php?title=Xiangqi&oldid=1057091174>>. (Year: 2021).*

*Primary Examiner* — Werner G Garner

(74) *Attorney, Agent, or Firm* — Li & Cai Intellectual Property (USA) Office

(57) ABSTRACT

A game board device is provided for carrying and identifying game pieces that are divided into different piece types. The game board device includes a board, a plurality of optically identifying modules, and a processing module electrically coupled to the optically identifying modules. The optically identifying modules respectively correspond in position to detection regions of the board. Each of the optically identifying modules includes a light emitter that can emit light toward the corresponding detection region and a light receiver that can receive light reflected by the corresponding detection region. When any one of the detection regions is in an unoccupied mode, the corresponding optically identifying module can emit an unoccupied signal. When any one of the detection regions is in an occupied mode, the corresponding optically identifying module enables an identification signal that corresponds to the piece type of the corresponding game piece to be emitted therefrom.

9 Claims, 14 Drawing Sheets

(56) References Cited

U.S. PATENT DOCUMENTS

| | | | | |
|---|---|---|---|---|
| 2008/0102963 | A1* | 5/2008 | Flagg | A63F 13/90 463/46 |
| 2012/0118969 | A1* | 5/2012 | Zolotov | G06K 7/1478 235/462.04 |
| 2018/0178113 | A1* | 6/2018 | Knippen | A63F 3/02 |
| 2020/0261785 | A1* | 8/2020 | Klemm | G06K 19/06037 |
| 2021/0187383 | A1* | 6/2021 | Hite | A63F 3/00261 |

* cited by examiner

GAME BOARD DEVICE

FIELD OF THE DISCLOSURE

The present disclosure relates to a board game, and more particularly to a game board device.

BACKGROUND OF THE DISCLOSURE

A conventional game board can be in cooperation with game pieces for jointly providing users to gather and play. However, the conventional game board is limited to the existing structural design, which gradually limits the application range of the conventional game board (e.g., the conventional game board is only used when users are gathered).

SUMMARY OF THE DISCLOSURE

In response to the above-referenced technical inadequacy, the present disclosure provides a game board device to effectively improve on the issues associated with conventional game board.

In one aspect, the present disclosure provides a board game device for identifying a plurality of game pieces that are disposed thereon and that are divided into different piece types. The board game device includes a plurality of identification labels, a board, a plurality of optically identifying modules, and a processing module. The identification labels are configured to be respectively connected to bottoms of the game pieces, so that any one of the identification labels corresponds to the piece type of the game piece connected thereto. The board defines a plurality of detection regions of an outer surface thereof. Each of the detection regions is configured to be in an unoccupied mode when none of the game pieces are placed thereon or an occupied mode when one of the game pieces is placed thereon through the corresponding identification label. The optically identifying modules face an inner surface of the board and respectively correspond in position to the detection regions. Each of the optically identifying modules includes a light emitter configured to emit light toward the corresponding detection region and a light receiver that corresponds in position to the light emitter. The board is configured to allow light emitted from the light emitter of any one of the optically identifying modules to pass there-through from the corresponding detection region. When any one of the detection regions is in the unoccupied mode, the light receiver of the corresponding optically identifying module is configured to emit an unoccupied signal. When any one of the detection regions is in the occupied mode, the light receiver of the corresponding optically identifying module is configured to receive light that is emitted from the light emitter of the corresponding optically identifying module and that is reflected by the corresponding identification label, so as to enable an identification signal that corresponds in type to the corresponding identification label to be emitted therefrom. The processing module is electrically coupled to the optically identifying modules so as to enable the processing module to transmit the unoccupied signal or the identification signal emitted from each of the optically identifying modules.

In certain embodiments, the identification labels have at least ten label types, and a quantity of the identification labels is greater than a quantity of the label types of the identification labels.

In certain embodiments, the identification labels include a plurality of grayscale patterns having a plurality of label types that are provided for respectively corresponding to the piece types of the game pieces.

In certain embodiments, the identification labels include a plurality of color patterns having a plurality of label types that are provided for respectively corresponding to the piece types of the game pieces.

In certain embodiments, the light emitter of each of the optically identifying modules is configured to emit an invisible light, and the board is opaque and is permeable by the invisible light.

In certain embodiments, the board game device further includes a plurality of indicators electrically coupled to the processing module. The indicators face the inner surface of the board and respectively correspond in position to the detection regions, and each of the indicators is configured to emit a visible light toward the corresponding detection region.

In certain embodiments, any one of the identification labels is configured to be fixedly connected to the bottom of the corresponding game piece.

In certain embodiments, any one of the identification labels is configured to be detachably connected to the bottom of the corresponding game piece.

In another aspect, the present disclosure provides a board game device for identifying a plurality of game pieces that are disposed thereon and that are divided into different piece types. The board game device includes a board, a plurality of optically identifying modules, and a processing module. The board defines a plurality of detection regions of an outer surface thereof. Each of the detection regions is configured to be in an unoccupied mode when none of the game pieces are placed thereon or an occupied mode when one of the game pieces is placed thereon. The optically identifying modules face an inner surface of the board and respectively correspond in position to the detection regions. Each of the optically identifying modules includes a light emitter configured to emit light toward the corresponding detection region and a light receiver that corresponds in position to the light emitter. The board is configured to allow light emitted from the light emitter of any one of the optically identifying modules to pass there-through from the corresponding detection region. When any one of the detection regions is in the unoccupied mode, the light receiver of the corresponding optically identifying module is configured to emit an unoccupied signal. When any one of the detection regions is in the occupied mode, the light receiver of the corresponding optically identifying module is configured to receive light that is emitted from the light emitter of the corresponding optically identifying module and that is reflected by the corresponding game piece, so as to enable an identification signal that corresponds to the piece type of the corresponding game piece to be emitted therefrom. The processing module is electrically coupled to the optically identifying modules so as to enable the processing module to transmit the unoccupied signal or the identification signal emitted from each of the optically identifying modules.

In certain embodiments, the board is limited to being a Go board having three hundred sixty one intersections, the detection regions are respectively arranged on the intersections of the Go board, and the game pieces include a plurality of black pieces and a plurality of white pieces.

In certain embodiments, the board game device further includes a plurality of indicators electrically coupled to the processing module. The indicators face the inner surface of the board and respectively correspond in position to the detection regions, and each of the indicators is configured to emit a visible light toward the corresponding detection region.

In certain embodiments, the processing module of the board game device is configured to receive an identification signal from another board game device so as to instruct a corresponding one of the indicators to emit the visible light.

In certain embodiments, the board game device further includes a calibration button electrically coupled to the processing module. When any one of the detection regions is in the occupied mode, the calibration button is pressable to allow the processing module to drive the light receiver of the corresponding optically identifying module to receive light that is emitted from the light emitter of the corresponding optically identifying module and that is reflected by the corresponding game piece, so as to enable a material confirming signal that corresponds to material of the corresponding game piece to be emitted therefrom. The identification signal emitted from the light receiver of each of the optically identifying modules is determined according to the material confirming signal.

In certain embodiments, in any one of the optically identifying modules, the light receiver has a first luminance value when the light emitter emits a light, the light receiver has a second luminance value when the light emitter does not emit a light, and any one of the unoccupied signal and the identification signal emitted from the light receiver is determined according to a difference between the first luminance value and the second luminance value.

In certain embodiments, the board is limited to being a chessboard having sixty four squares, the detection regions are respectively arranged on the squares of the chessboard, and each of the game pieces has an identification pattern formed on a bottom thereof.

In certain embodiments, the board is limited to being a Chinese chessboard having ninety intersections, the detection regions are respectively arranged on the intersections of the Chinese chessboard, and each of the game pieces has an identification pattern formed on a bottom thereof.

In certain embodiments, the light emitter of each of the optically identifying modules is configured to emit an invisible light. The board is opaque and is permeable by the invisible light.

In certain embodiments, the board game device further includes a plurality of indicators electrically coupled to the processing module. The indicators face the inner surface of the board and respectively correspond in position to the detection regions, and each of the indicators is configured to emit a visible light toward the corresponding detection region.

In certain embodiments, the board game device further includes a housing. The board is disposed on the housing so as to jointly define an accommodating space, and the optically identifying modules and the processing module are arranged in the accommodating space.

In certain embodiments, the processing module is configured to transmit the unoccupied signal or the identification signal of each of the optically identifying modules to an external electronic device through wireless transmission.

Therefore, the cooperation of the board and the optically identifying modules of the game board device in the present disclosure are configured to provide the mode of each of the detection regions to the processing module, so that the game board device can have a function for automatically identifying the mode of each of the detection regions, thereby effectively expanding the application of the game board device.

Moreover, the identification labels of the game board device in the present disclosure are provided according to the piece types of the game pieces, so that the game pieces in cooperation with the game board device of the present disclosure do not need to have an additional design or change (e.g., the game board device of the present disclosure can be used in cooperation with the game pieces of the existing market), thereby enabling the game board device to be easily accepted by the existing market.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
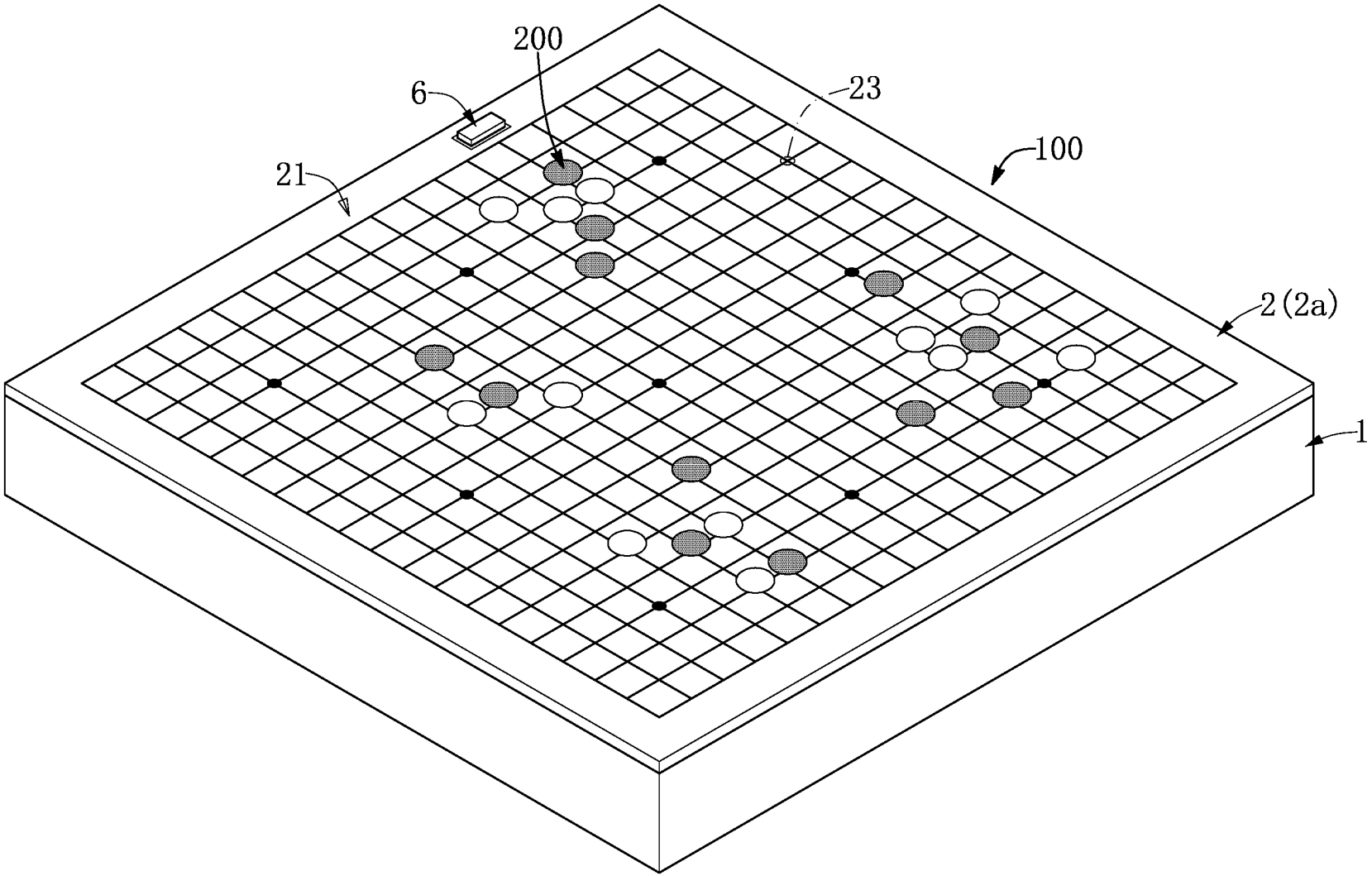
FIG. 1 is a perspective view showing a game board device and game pieces disposed thereon according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
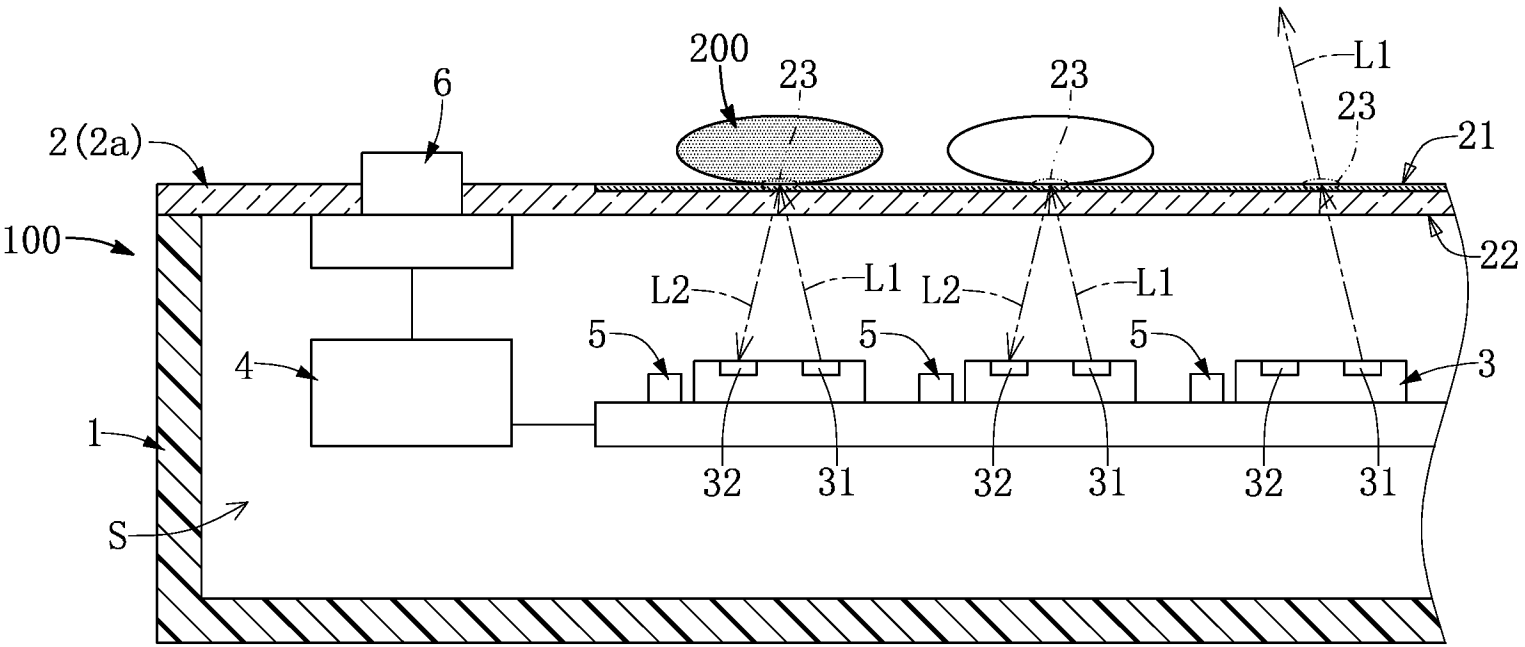
FIG. 2 is a partial cross-sectional view of FIG. 1.

Referring to FIG. 1 to FIG. 5, a first embodiment of the present disclosure provides a game board device 100 for identifying a plurality of game pieces 200 that are disposed thereon and that are divided into different piece types. As shown in FIG. 1 and FIG. 2, the game board device 100 includes a housing 1, a board 2 disposed on the housing 1, a plurality of optically identifying modules 3 corresponding in position to the board 2, a processing module 4 electrically coupled to the optically identifying modules 3, a plurality of indicators 5 electrically coupled to the processing module 4, and a calibration button 6 that is electrically coupled to the processing module 4.

It should be noted that the game board device 100 in the present embodiment is described by the above components in cooperation with each other, but the present disclosure is not limited thereto. For example, in other embodiments of the present disclosure, at least one of the housing 1, the indicators 5, and the calibration button 6 can be omitted or replaced by other components. The following description describes the structural and connection relationship of each of the components of the game board device 100.

Specifically, as shown in FIG. 1 and FIG. 2, the board 2 in the present embodiment is disposed on the housing 1 so as to jointly define an accommodating space S, and the optically identifying modules 3, the processing module 4, the indicators 5, and the calibration button 6 are arranged in the accommodating space S.

The board 2 is a flat structure and defines a plurality of detection regions 23 of an outer surface 21 thereof. Each of the detection regions 23 is configured to be in an unoccupied mode (e.g., the detection region 23 at the right side of FIG. 2) when none of the game pieces 200 are placed thereon or an occupied mode (e.g., the detection region 23 at the left side of FIG. 2) when one of the game pieces 200 is placed thereon. In order to clearly describe the present embodiment, the board 2 in the following description is limited to a Go board 2*a* having three hundred sixty one intersections, the detection regions 23 are respectively arranged on the intersections of the Go board 2*a*, and the game pieces 200 include a plurality of black pieces and a plurality of white pieces, but the present disclosure is not limited thereto.

The optically identifying modules 3 face an inner surface 22 of the board 2 and respectively correspond in position to the detection regions 23 (e.g., each of the optically identifying modules 3 is located under the corresponding detection region 23). The optically identifying modules 3 in the present embodiment are provided of a substantially same structure, but the present disclosure is not limited thereto. For example, in other embodiments of the present disclosure not shown in the drawings, the optically identifying modules 3 can be of different structures.

Each of the optically identifying modules 3 includes a light emitter 31 and a light receiver 32 that corresponds in position to the light emitter 31, in which the light emitter 31 and the light receiver 32 are preferably arranged to face the corresponding detection region 23. The light emitter 31 of each of the optically identifying modules 3 is configured to emit light L1 toward the corresponding detection region 23, in which the light L1 is preferable to be an invisible light. In the present embodiment, the board 2 is opaque and is permeable by the invisible light.

Specifically, the board 2 is configured to allow light L1 emitted from the light emitter 31 of any one of the optically identifying modules 3 to pass there-through from the corresponding detection region 23. Accordingly, when any one of the detection regions 23 is in the unoccupied mode (e.g., the detection region 23 at the right side of FIG. 2), the light receiver 32 of the corresponding optically identifying module 3 is configured to emit an unoccupied signal. Moreover, when any one of the detection regions 23 is in the occupied mode (e.g., the detection region 23 at the left side of FIG. 2), the light receiver 32 of the corresponding optically identifying module 3 is configured to receive light L2 that is emitted from the light emitter 31 of the corresponding optically identifying module 3 and that is reflected by the corresponding game piece 200, so as to enable an identification signal that corresponds to the piece type of the corresponding game piece 200 to be emitted therefrom.

It should be noted that the determined manner of the unoccupied signal and the occupied signal can be adjusted or changed according to design requirements, and the present disclosure is not limited thereto. In any one of the optically identifying modules 3 of the present embodiment, the light receiver 32 has a first luminance value when the light emitter 31 emits a light L1, the light receiver has a second luminance value when the light emitter 31 does not emit a light L1, and any one of the unoccupied signal and the identification signal emitted from the light receiver 32 is determined according to a difference between the first luminance value and the second luminance value. Accordingly, the game board device 100 in the present embodiment can be used to effectively reduce an influence caused by environment light through the above determined manner so as to accurately determine the unoccupied mode or the occupied mod.

The processing module 4 is provided by being electrically coupled to the optically identifying modules 3 so as to enable the processing module 4 to transmit the unoccupied signal or the identification signal emitted from each of the optically identifying modules 3. In the present embodiment, the processing module 4 can be configured to transmit the unoccupied signal or the identification signal of each of the optically identifying modules 3 to an external electronic device (e.g., another game board device 100*a* or an opponent's cell phone) through wireless transmission, but the present disclosure is not limited thereto.

In summary, the cooperation of the board 2 and the optically identifying modules 3 of the game board device 100 in the present embodiment can provide the mode of each of the detection regions 23 to the processing module 4, so that the game board device 100 can have a function for automatically identifying the mode of each of the detection regions 23, thereby effectively expanding the application of the game board device 100.

Figure 4:
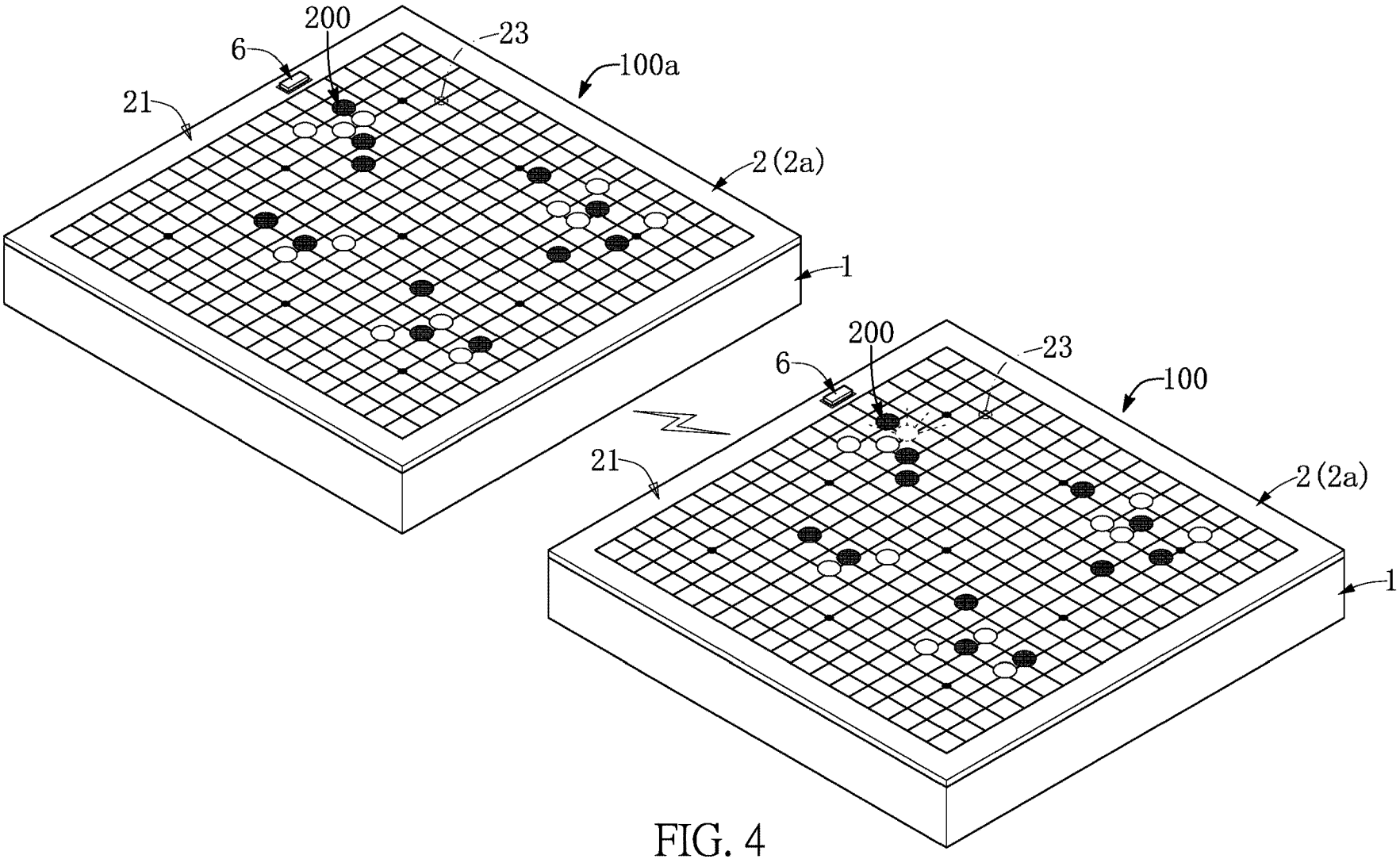
FIG. 4 is a perspective view showing the two game board devices wirelessly connected to each other according to the first embodiment of the present disclosure.
Figure 5:
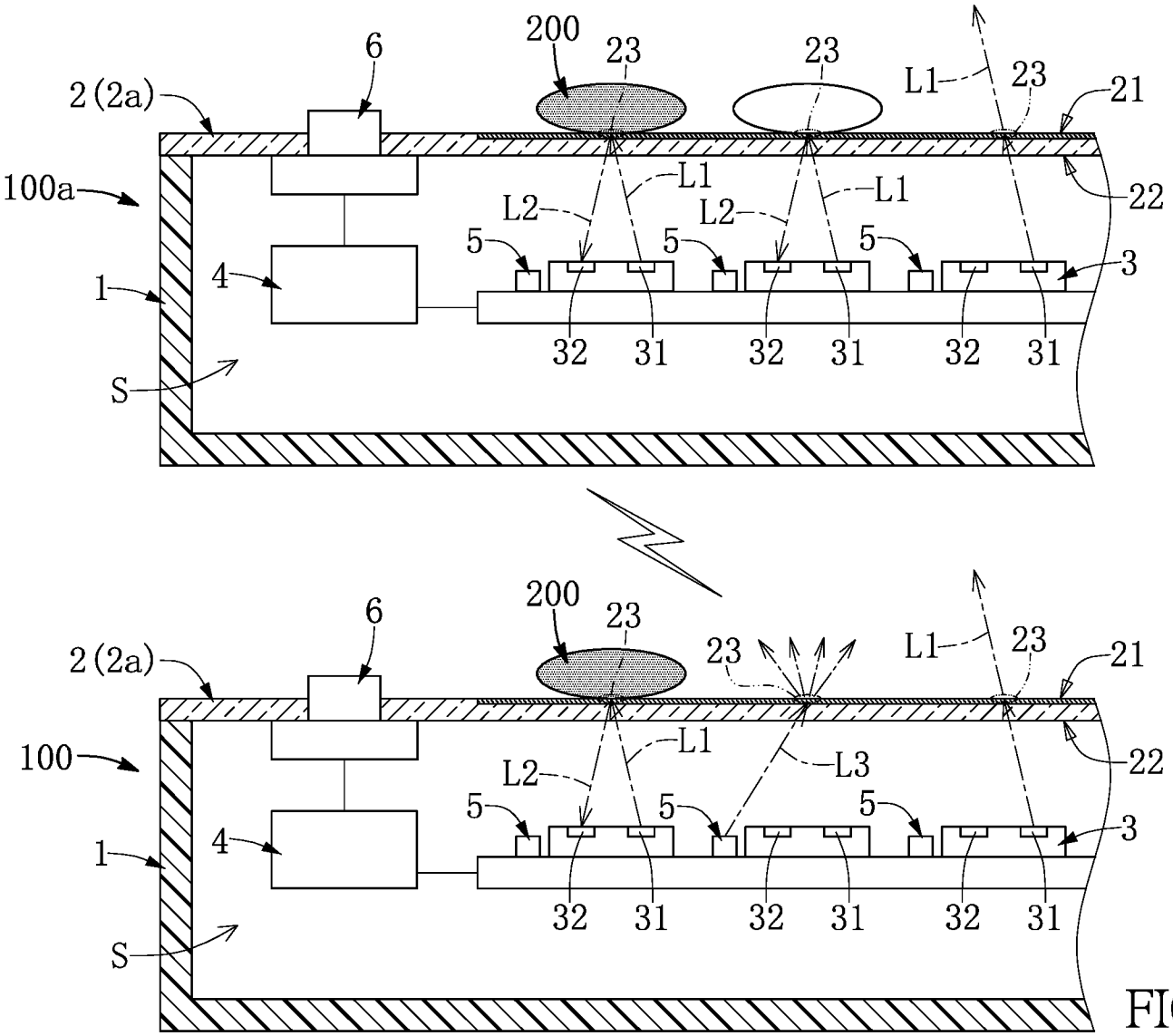
FIG. 5 is a partial cross-sectional view of FIG. 4.

Specifically, the indicators 5 face the inner surface 22 of the board 2 and respectively correspond in position to the detection regions 23, and each of the indicators 5 is configured to emit a visible light L3 toward the corresponding detection region 23. As shown in FIG. 4 and FIG. 5, the processing module 4 of the board game device 100 is configured to receive an identification signal from another board game device 100*a* (or an opponent's cell phone) so as to instruct a corresponding one of the indicators 5 to emit the visible light L3. Accordingly, the game board device 100 can provide the user to play with an opponent who is not present, and the game board devices 100 can provide the users to play with each other through wireless transmission.

Figure 3:
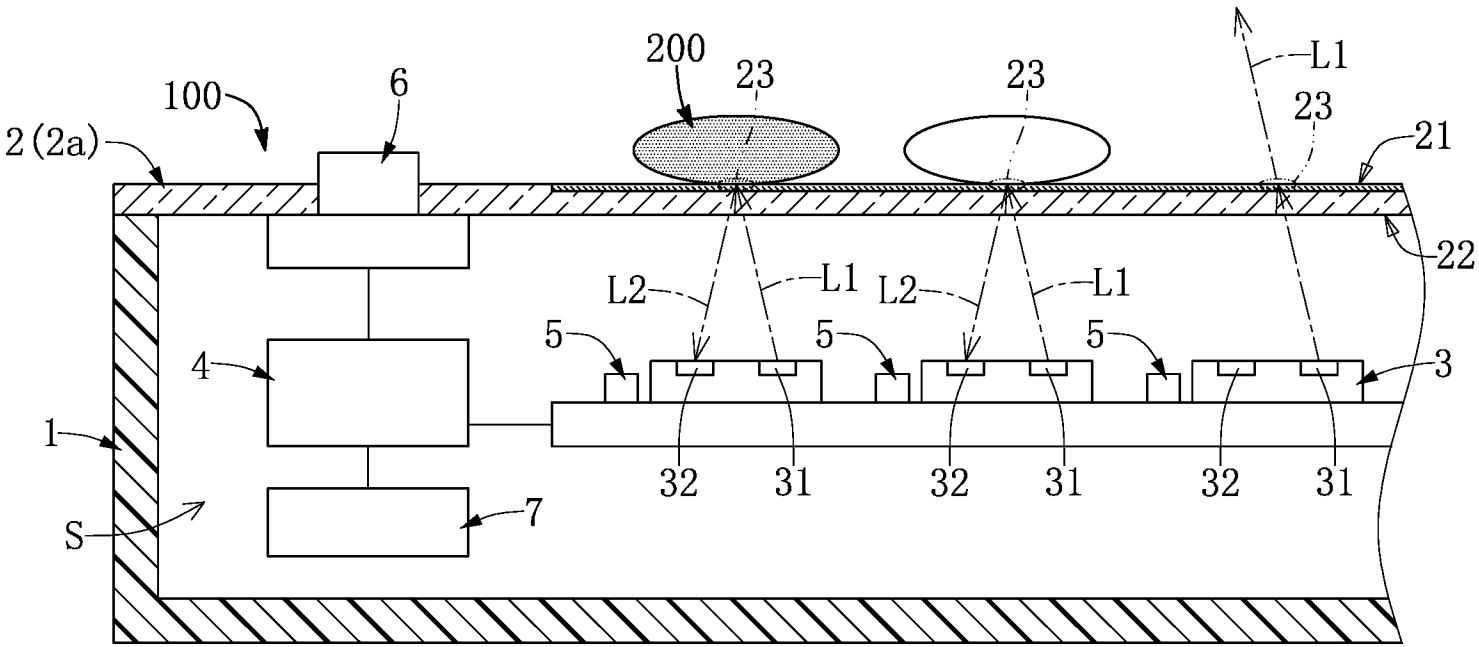
FIG. 3 is a partial cross-sectional view of FIG. 1 showing another configuration of the game board device.

In addition, as shown in FIG. 3, the game board device 100 can further include an artificial intelligence (AI) module 7 that is arranged in the accommodating space S and that is electrically coupled to the processing module 4. The processing module 4 is configured to transmit the unoccupied signal or the identification signal to the AI module 7, so that the AI module 7 can be operated to teach or play with the user through the indicators 5.

Moreover, as shown in FIG. 1 and FIG. 2, since the game pieces 200 in the existing market can be made of different materials, and in order to enable the game board device 100 to accurately determine the material and the piece type of the game piece 200, the game board device 100 in the present embodiment is provided with the calibration button 6 electrically coupled to the processing module 4.

Specifically, before the game board device 100 is used, any one of the detection regions 23 can be in the occupied mode by placing one of the game pieces 200 thereon, and the calibration button 6 is pressable to allow the processing module 4 to drive the light receiver 32 of the corresponding optically identifying module 3 to receive light L2 that is emitted from the light emitter 31 of the corresponding optically identifying module 3 and that is reflected by the corresponding game piece 200, so as to enable a material confirming signal that corresponds to material of the corresponding game piece 200 to be emitted therefrom. Accordingly, the identification signal emitted from the light receiver 32 of each of the optically identifying module 3 is determined according to the material confirming signal, thereby accurately determining the piece type of the game piece 200.

Second Embodiment

Referring to FIG. 6 to FIG. 10, a second embodiment of the present disclosure is provided, which is similar to the first embodiment of the present disclosure. For the sake of brevity, descriptions of the same components in the first and second embodiments of the present disclosure will be omitted herein, and the following description only discloses different features between the first and second embodiments.

Figure 6:
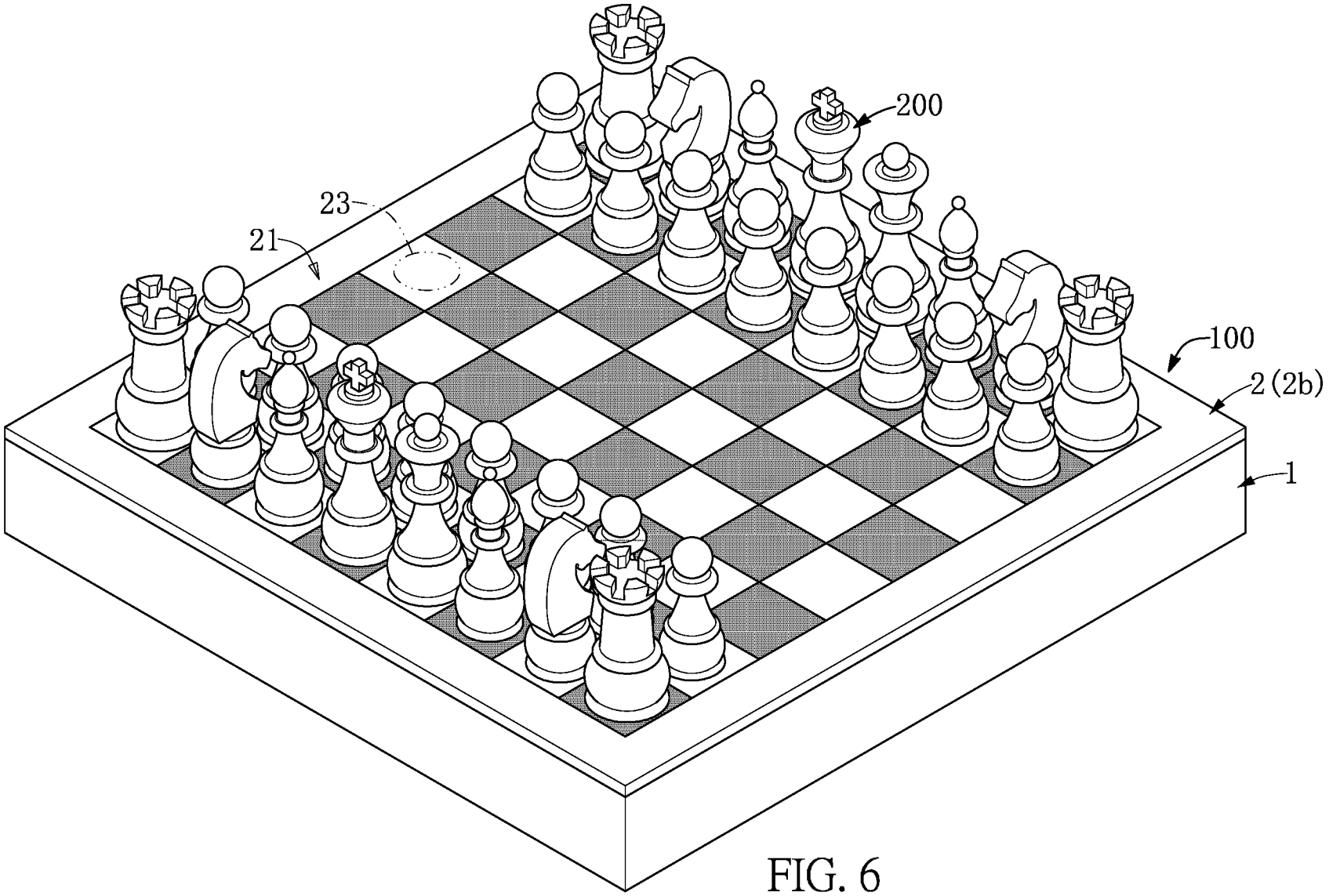
FIG. 6 is a perspective view showing the game board device and the game pieces disposed thereon according to a second embodiment of the present disclosure.
Figure 7:
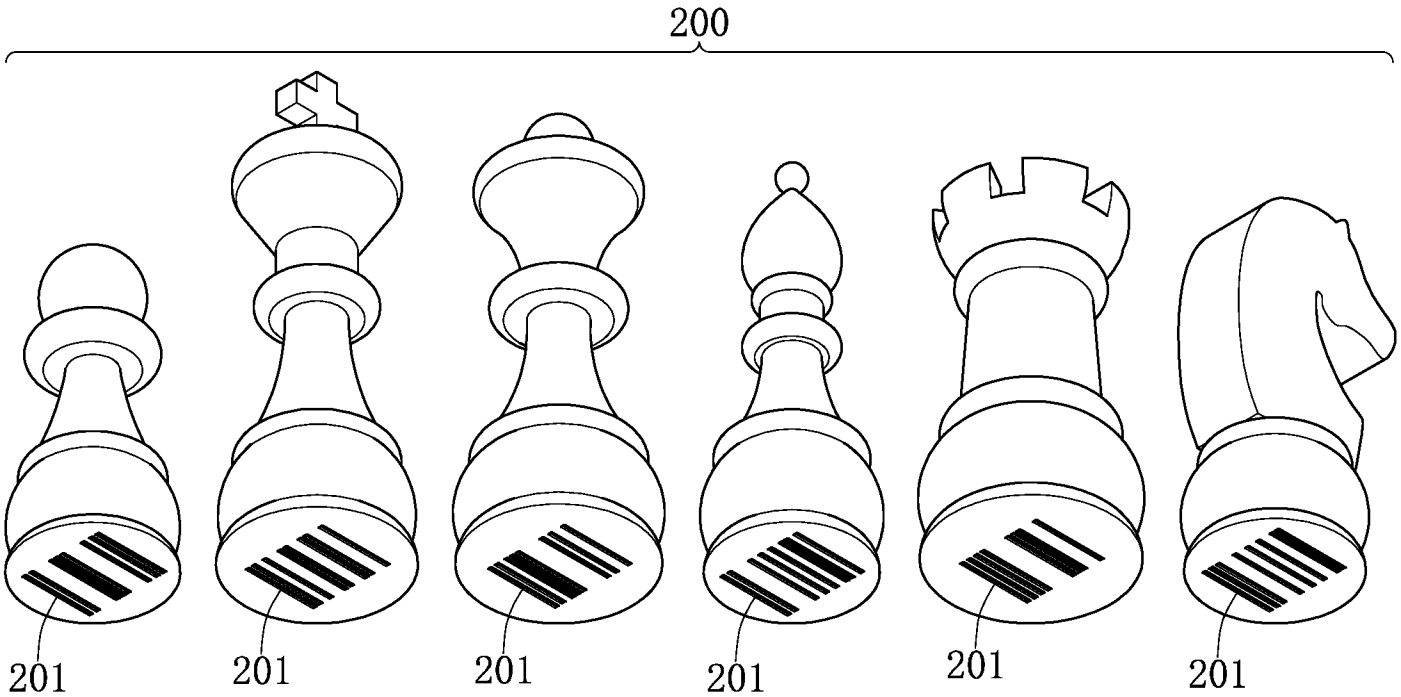
FIG. 7 is a perspective view showing the game pieces according to the second embodiment of the present disclosure.
Figure 8:
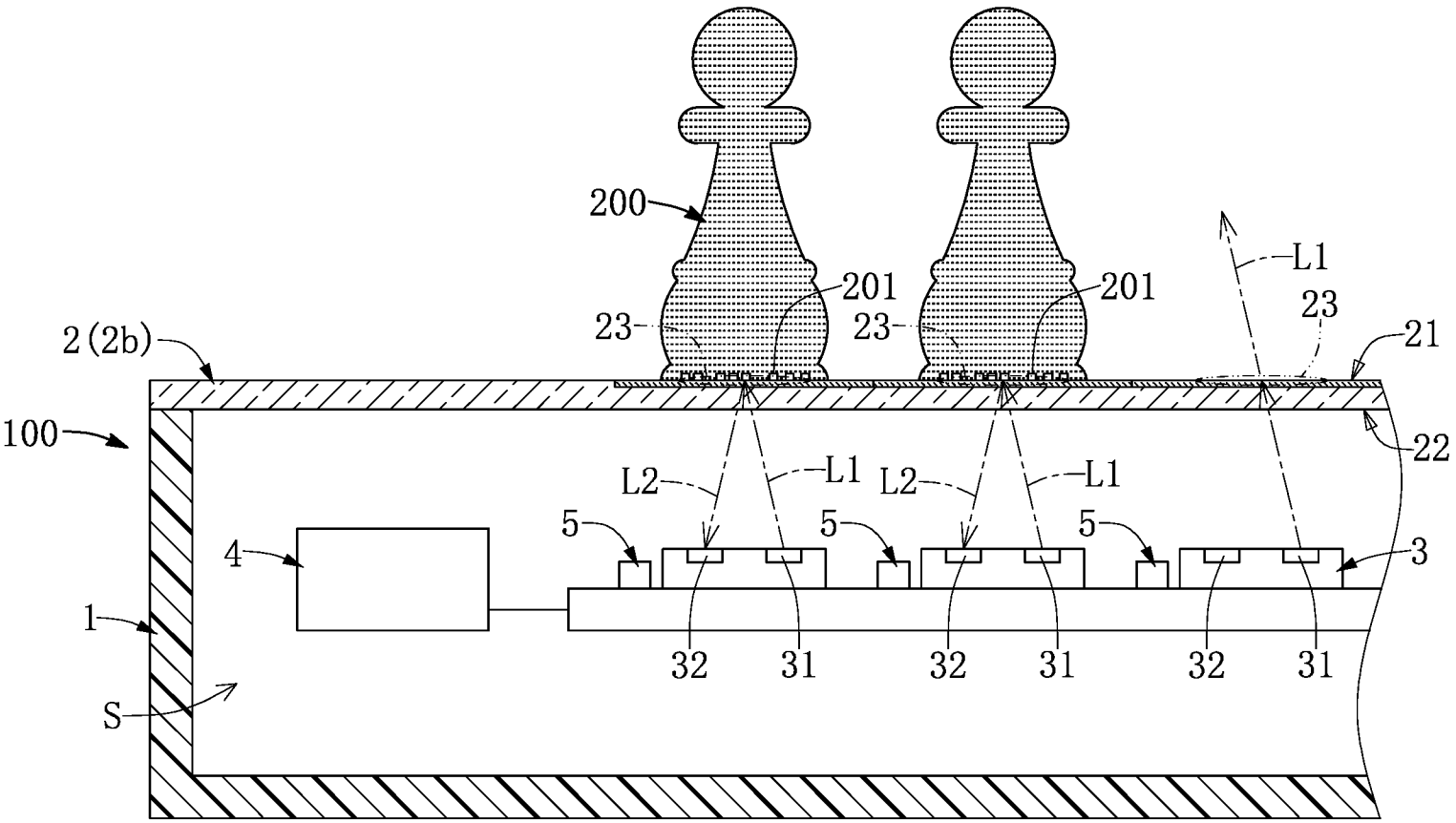
FIG. 8 is a partial cross-sectional view of FIG. 6.
Figure 9:
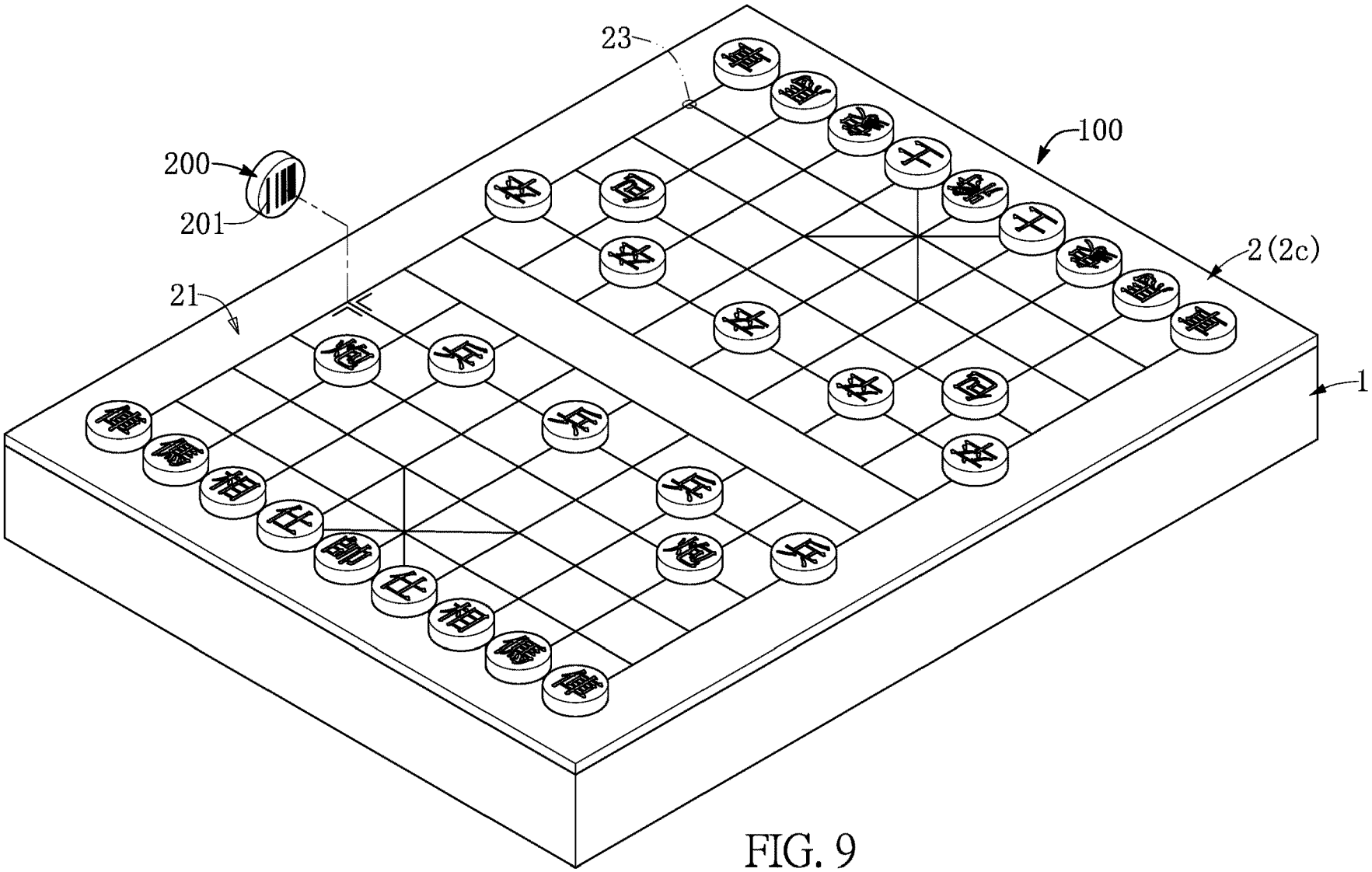
FIG. 9 is a perspective view showing the game board device in another type and the corresponding game pieces disposed thereon according to the second embodiment of the present disclosure.
Figure 10:
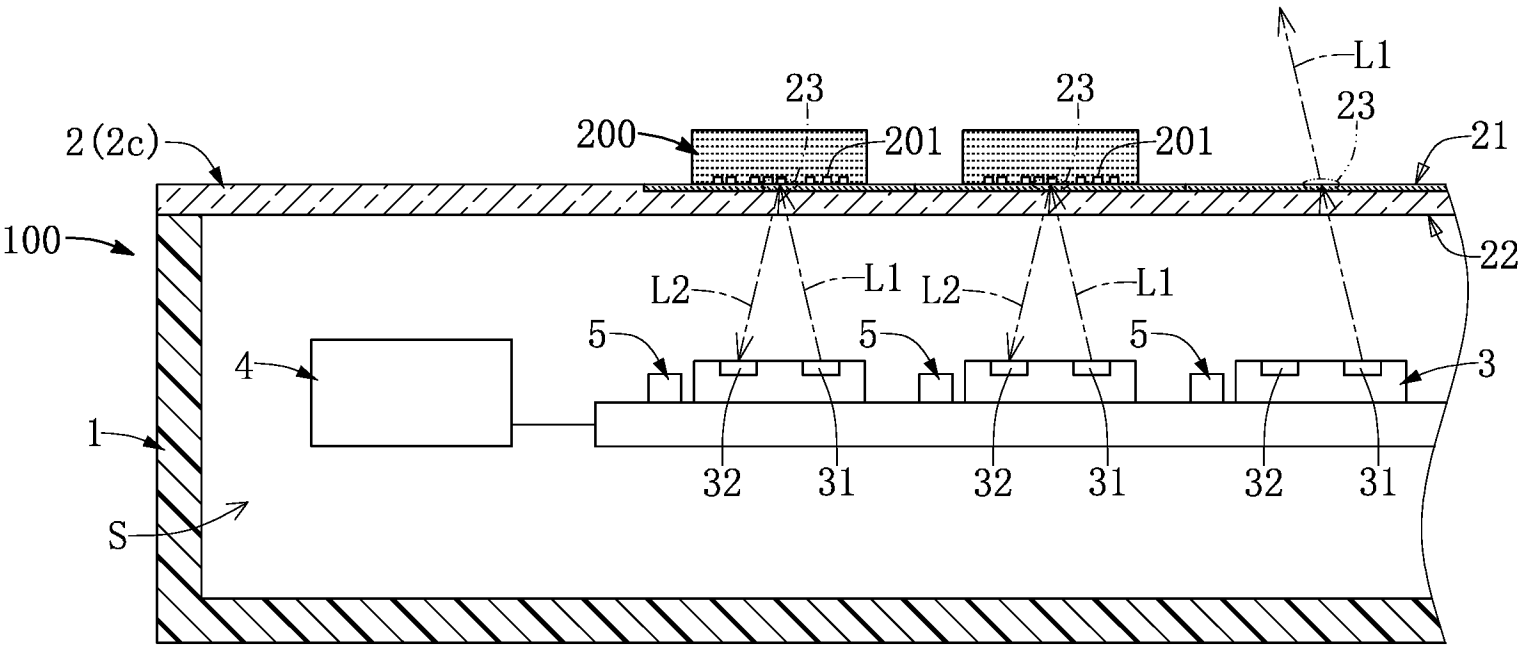
FIG. 10 is a partial cross-sectional view of FIG. 9.

As shown in FIG. 6 to FIG. 8 of the present embodiment, the board 2 can be limited to a chessboard 2*b* having sixty four squares, the detection regions 23 are respectively arranged on the squares of the chessboard 2*b*, and each of the game pieces 200 has an identification pattern 201 formed on a bottom thereof. Moreover, as shown in FIG. 9 and FIG. 10 of the present embodiment, the board 2 can be limited to being a Chinese chessboard 2*c* having ninety intersections, the detection regions 23 are respectively arranged on the intersections of the Chinese chessboard 2*c*, and each of the game pieces 200 has an identification pattern 201 formed on a bottom thereof.

Accordingly, when any one of the detection regions 23 is in the occupied mode (e.g., the detection region 23 at the left side of FIG. 8 or FIG. 10), the light receiver 32 of the corresponding optically identifying module 3 is configured to receive light L2 that is emitted from the light emitter 31 of the corresponding optically identifying module 3 and that is reflected by the corresponding identification pattern 201, so as to enable an identification signal that corresponds in type to the corresponding identification pattern 201 to be emitted therefrom.

It should be noted that the identification pattern 201 in the present embodiment is formed on the corresponding game piece 200 in a non-detachable manner. For example, the identification pattern 201 can be directly recessed in the bottom of the corresponding game piece 200; or, the identification pattern 201 can be coated or printed on the bottom of the corresponding game piece 200, but the present disclosure is not limited thereto. In addition, in other embodiments of the present disclosure not shown in the drawings, the game board device can be adjusted to be applied to any kind of board game, thereby effectively expanding the application of the board game.

Third Embodiment

Referring to FIG. 11 to FIG. 14, a third embodiment of the present disclosure is provided, which is similar to the second embodiment of the present disclosure. For the sake of brevity, descriptions of the same components in the second and third embodiments of the present disclosure will be omitted herein, and the following description only discloses different features between the second and third embodiments.

In the present embodiment, the game board device 100 further includes a plurality of identification labels 8. The identification labels 8 are configured to be respectively connected to bottoms of the game pieces 200, so that any one of the identification labels 8 corresponds to the piece type of the game piece 200 connected thereto. Moreover, any one of the identification labels 8 can be fixedly connected to the bottom of the corresponding game piece 200; or, any one of the identification labels 8 can be detachably connected to the bottom of the corresponding game piece 200.

Accordingly, the identification labels 8 of the game board device 200 are provided according to the piece types of the game pieces 200, so that the game pieces 200 in cooperation with the game board device 200 do not need to have an additional design or change (e.g., the game board device 200 can be used in cooperation with the game pieces 200 of the existing market), thereby enabling the game board device 200 to be easily accepted by the existing market.

Specifically, the identification labels 8 have at least ten label types, and a quantity of the identification labels 8 is greater than a quantity of the label types of the identification labels 8, but the present disclosure is not limited thereto. In other words, the identification labels 8 can be provided to be applied to any kind of board game (e.g., the chessboard game or the Chinese chessboard game).

Figure 11:
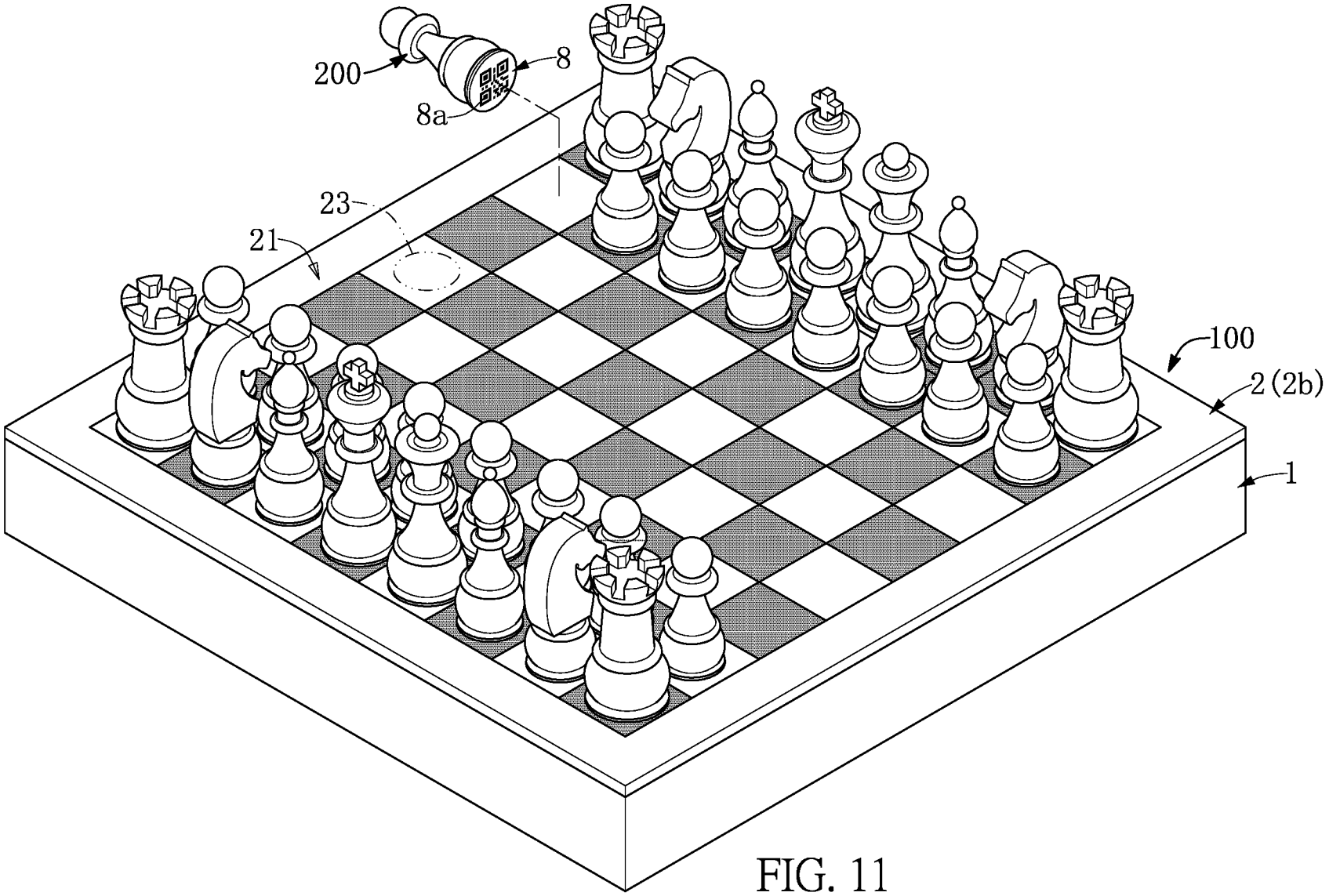
FIG. 11 is a perspective view showing the game board device and the game pieces disposed thereon according to a third embodiment of the present disclosure.
Figure 12:
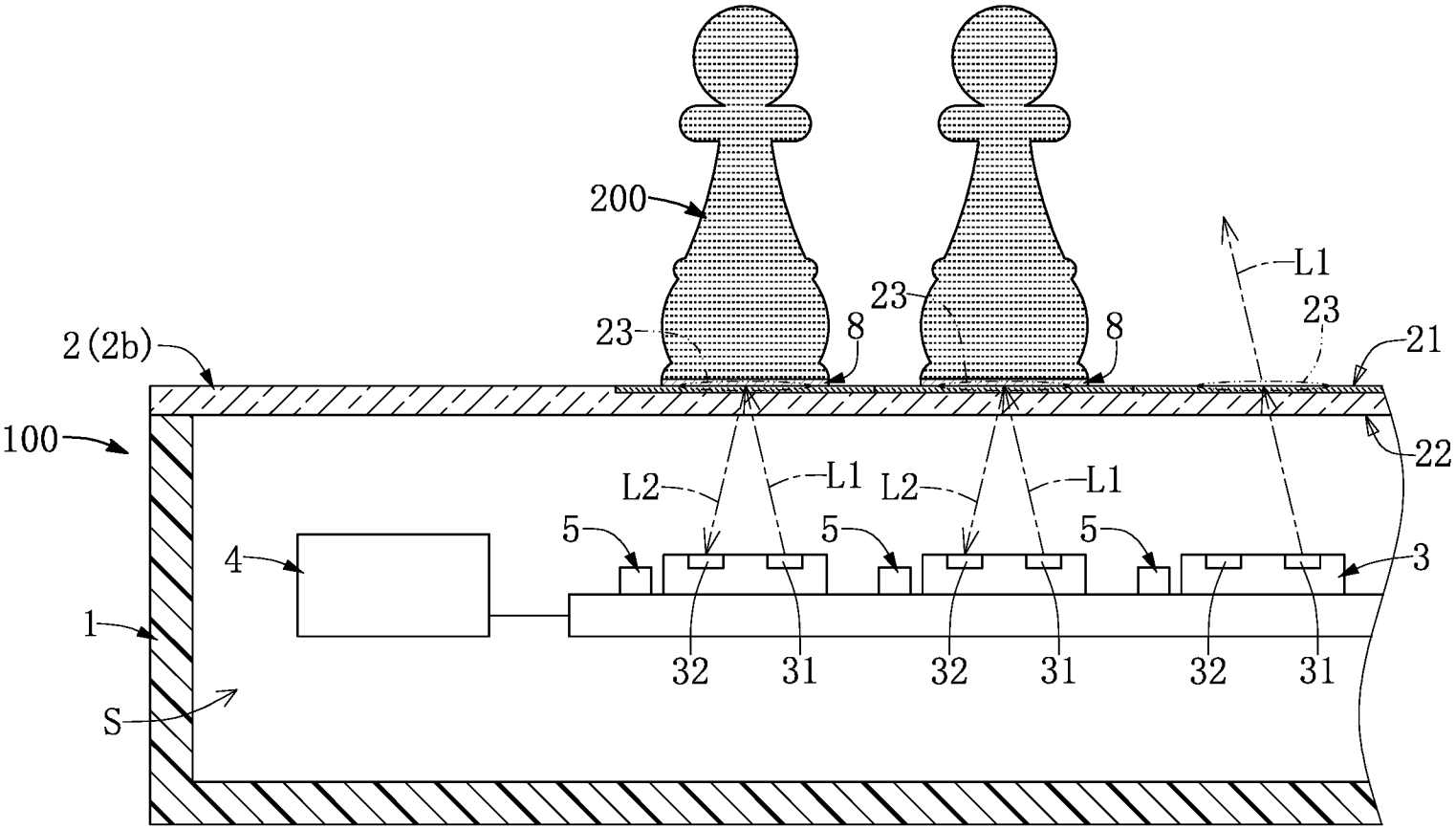
FIG. 12 is a partial cross-sectional view of FIG. 11.
Figure 13:
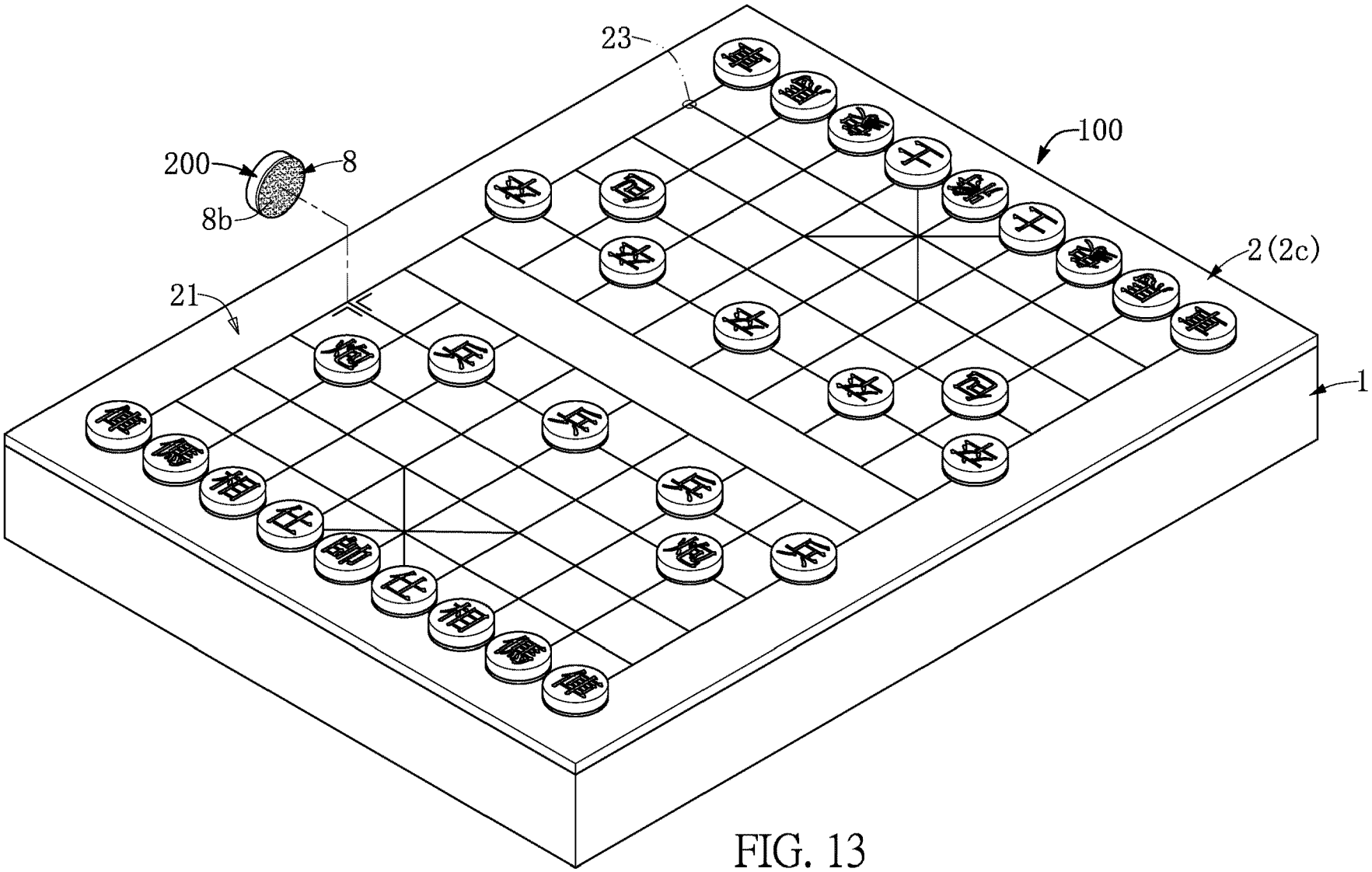
FIG. 13 is a perspective view showing the game board device in another type and the corresponding game pieces disposed thereon according to the third embodiment of the present disclosure.
Figure 14:
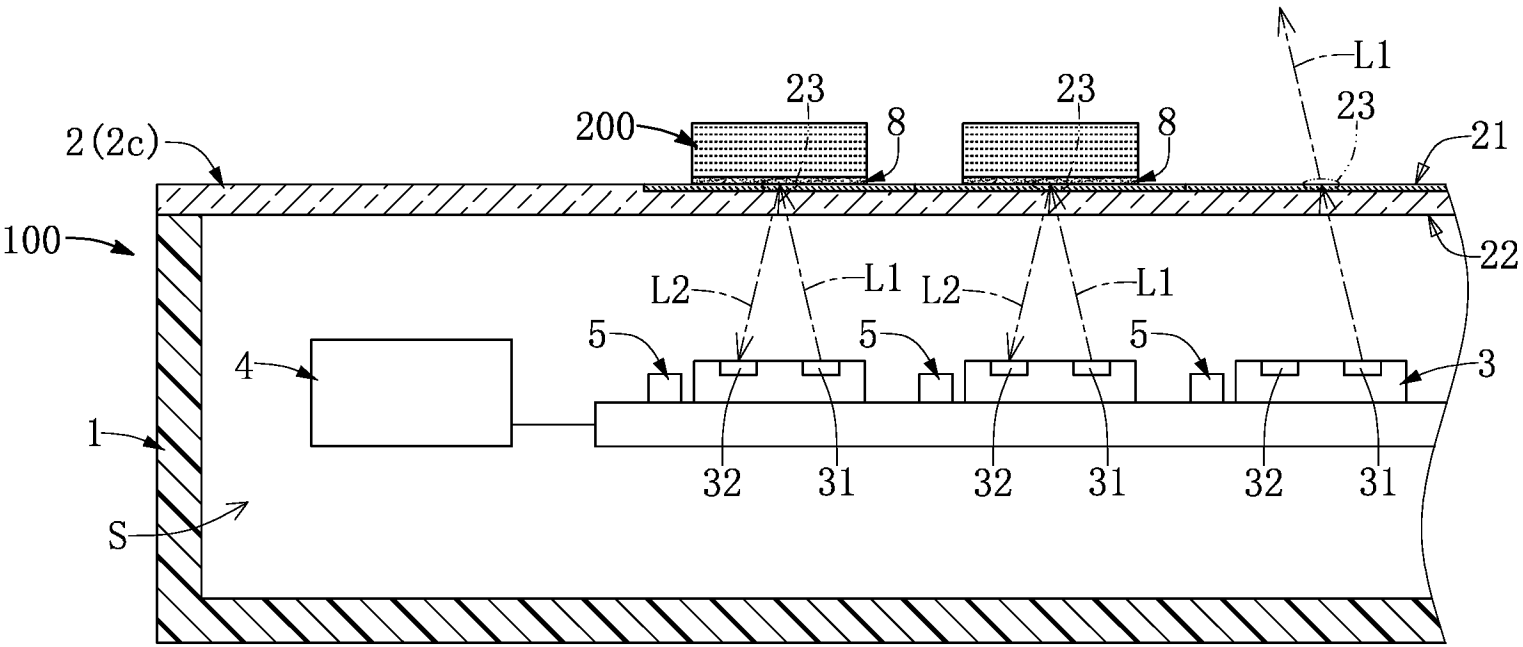
FIG. 14 is a partial cross-sectional view of FIG. 13.

Moreover, a distinguishing manner among the identification labels 8 can be changed according to design requirements, and is not limited by the present embodiment. For example, as shown in FIG. 11 and FIG. 12, the identification labels 8 include a plurality of grayscale patterns 8*a* having a plurality of label types that are provided for respectively corresponding to the piece types of the game pieces 200; or, as shown in FIG. 13 and FIG. 14, the identification labels 8 include a plurality of color patterns 8*b* having a plurality of label types that are provided for respectively corresponding to the piece types of the game pieces 200. However, in other embodiments of the present disclosure not shown in the drawings, the identification labels 8 can include a plurality of grayscale patterns 8*a* and a plurality of color patterns 8*b*.

In summary, when any one of the detection regions 23 is in the unoccupied mode (e.g., the detection region 23 at the right side of FIG. 12 or FIG. 14), the light receiver 32 of the corresponding optically identifying module 3 is configured to emit an unoccupied signal. Moreover, when any one of the detection regions 23 is in the occupied mode (e.g., the detection region 23 at the left side of FIG. 12 or FIG. 14), the light receiver 32 of the corresponding optically identifying module 3 is configured to receive light L2 that is emitted from the light emitter 31 of the corresponding optically identifying module 1 and that is reflected by the corresponding identification label 8, so as to enable an identification signal that corresponds in type to the corresponding identification label 8 to be emitted therefrom.

Beneficial Effects of the Embodiments

In conclusion, the cooperation of the board and the optically identifying modules of the game board device in the present disclosure are configured to provide the mode of each of the detection regions to the processing module, so that the game board device can have a function for automatically identifying the mode of each of the detection regions, thereby effectively expanding the application of the game board device.

Moreover, the identification labels of the game board device in the present disclosure are provided according to the piece types of the game pieces, so that the game pieces in cooperation with the game board device of the present disclosure do not need to have an additional design or change (e.g., the game board device of the present disclosure can be used in cooperation with the game pieces of the existing market), thereby enabling the game board device to be easily accepted by the existing market.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A board game device capable of identifying a plurality of game pieces that are disposed thereon and that are divided into different piece types, the board game device comprising:

a plurality of identification labels configured to be arranged respectively at bottom portions of the game pieces, wherein each one of the identification labels represents a piece type of the game piece;

a board having a plurality of detection regions defining an outer surface thereof, each of the detection regions being selectively recognizable between (a) an unoccupied mode when none of the game pieces are placed thereon; (b) an unoccupied mode when a game piece without an identification label is placed on one of the detection regions; and (c) an occupied mode when one of the game pieces is placed thereon through the corresponding identification label;

a plurality of optically identifying modules facing an inner surface of the board and respectively corresponding in position to the detection regions, wherein each of the optically identifying modules includes:

a light emitter configured to emit light toward the corresponding detection region; and a light receiver corresponding in position to the light emitter;

wherein the board is configured to allow a light emission from the light emitter of the optically identifying modules to pass through one of the corresponding detection regions;

wherein, when one of the detection regions is in the unoccupied mode, the light receiver of the corresponding optically identifying module is configured to emit an unoccupied signal; and wherein, when one of the detection regions is in the occupied mode, the light receiver of the corresponding optically identifying module is configured to receive the light emission from the light emitter of the corresponding optically identifying module and reflected by the corresponding identification label, wherein the light receiver enables and emits an identification signal that corresponds in type to the corresponding identification label;

a processing module electrically coupled to the optically identifying modules to receive the unoccupied signal or the identification signal emitted from the light receiver of each of the optically identifying modules; and a plurality of indicators respectively corresponding to each of the detection regions of the board, arranged to selectively provide visual indication of the unoccupied mode and the occupied mode at the corresponding detection region.

2. The board game device according to claim 1, wherein the identification labels have at least ten label types, and a quantity of the identification labels is greater than a quantity of the label types of the identification labels.

3. The board game device according to claim 1, wherein the identification labels include a plurality of grayscale patterns having a plurality of label types that are provided for respectively corresponding to the piece types of the game pieces.

4. The board game device according to claim 1, wherein the identification labels include a plurality of color patterns having a plurality of label types that are provided for respectively corresponding to the piece types of the game pieces.

5. The board game device according to claim 1, wherein the light emitter of each of the optically identifying modules is configured to emit an invisible light, and wherein the board is opaque and is permeable by the invisible light.

6. The board game device according to claim 1, wherein the indicators are electrically coupled to the processing module, wherein the indicators face the inner surface of the board and respectively correspond in position to the detection regions, and each of the indicators is configured to emit a visible light toward the corresponding detection region.

7. The board game device according to claim 1, wherein any one of the identification labels is configured to be fixedly connected to the bottom portion of the corresponding game piece.

8. The board game device according to claim 1, wherein any one of the identification labels is configured to be detachably connected to the bottom portion of the corresponding game piece.

9. A board game device capable of identifying a plurality of game pieces that are disposed thereon and that are divided into different piece types, the board game device comprising:

a plurality of identification labels configured to be arranged respectively on the game pieces at locations accessible by a respective one of a plurality of optically identifying modules, wherein each one of the identification labels represents a piece type of the game piece;

a board having a plurality of detection regions defined on an outer surface thereof, each of the detection regions being selectively recognizable between an unoccupied mode when none of the game pieces are placed thereon and an occupied mode when one of the game pieces is placed thereon through the corresponding identification label;

a plurality of optically identifying modules facing an inner surface of the board and respectively corresponding in position to the detection regions, wherein each of the optically identifying modules includes:

a light emitter configured to emit light toward the corresponding detection region; and a light receiver corresponding in position to the light emitter;

wherein the board allows a light emission from the light emitter of the optically identifying modules to pass through one of the corresponding detection regions;

wherein the light receiver of the corresponding optically identifying module selectively emits:

(a) an unoccupied signal when one of the detection regions is in the unoccupied mode;

(b) an unoccupied signal when a game piece without an identification label is placed on one of the detection regions; and (c) an identification signal that corresponds in type to the corresponding identification label when one of the detection regions is in the occupied mode; and a processing module electrically coupled to the optically identifying modules to receive the unoccupied signal or the identification signal emitted from the light receiver of each of the optically identifying modules.

* * * * *